United States Patent [19]

Kuhn

[11] 4,106,325

[45] Aug. 15, 1978

[54] CHISEL CLAMP FOR USE IN STRAIGHTENING AUTOMOBILE BODIES

[76] Inventor: Charles J. Kuhn, 10520 Plainview Ave., Tujunga, Calif. 91042

[21] Appl. No.: 690,404

[22] Filed: May 27, 1976

[51] Int. Cl.[2] ..... B21D 1/12

[52] U.S. Cl. ..... 72/457; 72/705

[58] Field of Search ..... 72/457, 460, 705, 303; 24/263 A, 263 LS

[56] References Cited

U.S. PATENT DOCUMENTS

| | | | |
|---|---|---|---|
| 1,516,489 | 11/1924 | Barton | 24/263 A |
| 1,659,576 | 2/1928 | Brady et al. | 24/263 A |
| 2,608,730 | 9/1952 | Killius | 72/705 |
| 3,338,086 | 8/1967 | Hunter | 72/457 |
| 3,610,022 | 10/1971 | Lincourt | 72/705 |
| 3,992,921 | 11/1976 | Jarman | 72/705 |

FOREIGN PATENT DOCUMENTS

| | | | |
|---|---|---|---|
| 1,183,218 | 3/1970 | United Kingdom | 72/705 |

*Primary Examiner*—C.W. Lanham
*Assistant Examiner*—D. M. Gurley
*Attorney, Agent, or Firm*—Christie, Parker & Hale

[57] ABSTRACT

A chisel clamp used to provide a pulling point or anchor point when straightening automobile bodies comprises a pair of jaws each having a blade edge at one end and a serrated surface extending inboard the blade edge. The jaws are clamped to a structural member, such as the sheet metal floor of the automobile trunk space, by (1) hammering the blade edges of the jaws into the automobile body to sandwich the trunk floor between the serrated surfaces of the jaws; (2) aligning portions of the jaws which remain outside the automobile body to provide a corresponding alignment of threaded holes in the serrated portions of the jaws which are not mutually visible to the repairman because of their location on opposite sides of the trunk floor, and (3) tightening threaded fasteners engaged with the threaded holes to clamp the serrated surfaces of the jaws against the trunk floor. A chain rigidly affixed to the outside portion of the jaws provides an anchor point or pulling point for use in applying force to an automobile body member via the clamp's attachment to the trunk floor.

15 Claims, 3 Drawing Figures

CHISEL CLAMP FOR USE IN STRAIGHTENING AUTOMOBILE BODIES

BACKGROUND

This invention, in terms of apparatus, relates to a chisel clamp for being used to provide an anchor point or pulling point when straightening structural frame or body members of an automobile. In terms of method, the invention includes techniques for attaching the chisel clamp, say to the trunk floor of the automobile, to provide a pulling point or anchor point.

When repairing the frame damage of automobiles, it is common to use a power-pull system in which one end of the automobile frame is anchored by attachment to a chain extending to a tie-down point on the ground. A pulling force is applied to the opposite end of the frame from a chain engaged at one end with a hydraulic pulley apparatus and attached at the opposite end to a pulling point on the automobile frame. It is normally a relatively simple matter to find a secure point for attaching a chain to at least the front portion of the automobile frame in preparation for straightening the automobile.

When straightening the rear portions of an automobile frame, body or floor area, it has often been the practice to attach a clamp to a sheet metal lip of the automobile body which protrudes below the rear trunk space. Typically, the clamp is attached to a chain which, in turn, is attached to a hydraulic pulley apparatus for pulling against the clamp's point of attachment to the rear lip of the automobile body. The pulling force is applied against an anchor provided by a separate chain or cable attached to a front frame member and extending to a tie-down point in front of the automobile. The clamp has teeth which bite into the metal lip and provide a good grip for the pulling point when the jaws of the clamp are bolted together.

In recent years, the metal used in many automobile bodies, including the lip below the trunk space, has not been strong enough to withstand being torn or at least pulled out of shape when a pulling force of sufficient magnitude to straighten the body, frame, or floor area is applied via a clamp attached to the automobile body.

SUMMARY

The present invention provides a method and apparatus for straightening a structural member of an automobile without requiring an anchor point or pulling point say on the protruding lip of the body below the rear trunk space. Thus, the invention avoids tearing, marring or other damage done to the body of the automobile when a rear portion of the automobile is being straightened.

Briefly, the invention includes a chisel clamp comprising a pair of elongated jaws each having a blade edge at one end and a serrated clamping surface extending inboard the blade edge. Fastening means are releasably engaged with the clamping surface portions of the jaws. The fastening means can be loosened or tightened so the clamping surfaces can apply a controllable amount of pressure to opposite sides of a workpiece, such as the floor of an automobile trunk, sandwiched between the jaws. The portion of the jaws remote from each blade edge includes means for aligning the jaws in an overlying relation so that the fastening means can be engaged with both jaws while the workpiece is sandwiched between them. Flexible chain means affixed to at least one of the jaws is used to apply force to an automobile body member via the chisel clamp's attachment to the workpiece.

In a preferred method of straightening an automobile body member, the blade end of one jaw is hammered through a portion of the automobile body adjacent a structural member to be used as a pulling point or an anchor point. The jaw is hammered through the body to position the serrated clamping surface thereof so it overlies one surface of the structural member. The blade end of the other jaw is then hammered through the body to position the serrated clamping surface thereof adjacent the opposite surface of the structural member. Portions of the jaws remote from the blade edges protrude outside the automobile body so that the alignment means may cooperate to provide corresponding alignment of the fastening means while the structural member is disposed between the jaws. The fastening means then may be extended through the aligned serrated portions of the jaws and also through the structural member and tightened to clamp the jaws against the member to provide a rigid pulling point or anchor point when applying force to the automobile body.

In the presently preferred method, the chisel clamp is hammered through the rear portion of the automobile body and clamped to opposite sides of the sheet metal floor of the rear trunk space. The trunk floor of most automobiles is of much greater strength than the body, and therefore provides a rigid point of attachment for applying the necessary pulling force. Use of the trunk floor as a pulling point, or an anchor point, avoids substantial damage or distortion to the protruding rear lip of the automobile body which is often caused when using this portion of the body as a pulling point or an anchor point.

These and other aspects of the invention will be more fully understood by referring to the following detailed description and the accompanying drawing.

DRAWING

DETAILED DESCRIPTION

Figure 1:
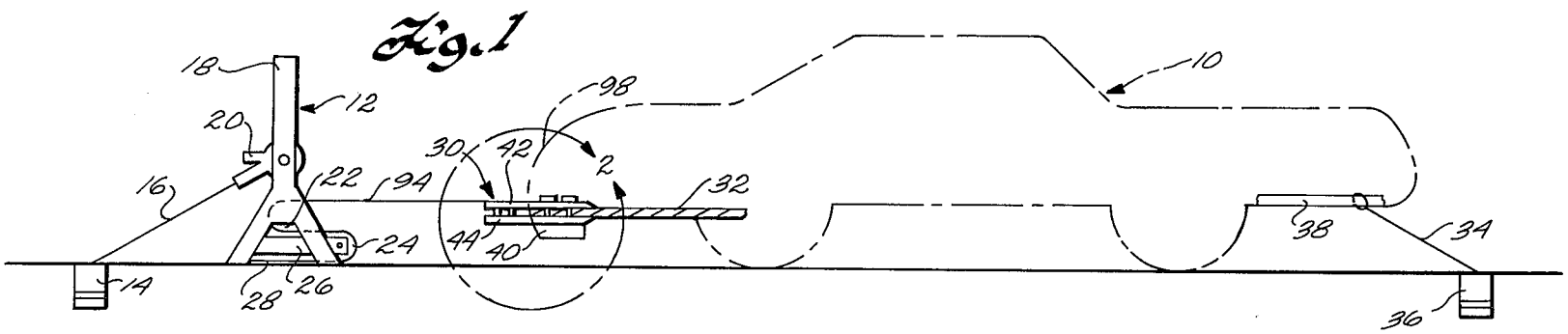
FIG. 1 is a schematic side elevation view showing the chisel clamp of this invention and a presently preferred method of use.

Referring to FIG. 1, a member of an automobile 10 is straightened by the apparatus and method of this invention. In the preferred method, the automobile body member is straightened by a hydraulic pulley apparatus 12 which is anchored to a tie-down device 14 by means of a cable or chain 16. The hydraulic pulley apparatus 12 is conventional and can be the type of pull device disclosed in my U.S. Pat. No. 3,589,680. This device generally includes a pair of side-by-side upright inverted Y-shaped frames 18, and an attachment device 20 between the frames 18 for holding one end of the anchor chain 16. The free end of the chain 16 is attached to the tie-down device 14 which can be of the type disclosed in my U.S. Pat. No. 3,494,587. The hydraulic pulley apparatus 12 also includes an essentially fixed pulley 22 near the apex of the Y, and a movable pulley 24 below pulley 22 and attached to a hydraulic ram 26. A flexible chain or cable 28 extends from an attachment device (not shown) on the frames 18, around the pulley 24 and the pulley 22, and then to a fixed point of attachment on the end of a chisel clamp 30 according to this invention. The chisel clamp 30 is affixed to a rigid structural member of the automobile, preferably the sheet metal floor 32 of the rear trunk space.

In using the hydraulic pulley apparatus 12, the hydraulic cylinder 26 is pressurized to extend the piston of the ram 26 and move the pulley 24 to the right in FIG. 1. This, in effect, extends the length of the chain around the pulleys 22 and 24, and exerts a pulling force, to the left in FIG. 1, on the trunk floor 32.

When a pulling force is applied to the rear portion of the automobile 10, the front of the automobile is anchored against the pulling force by a flexible chain or cable 34 attached to a tie-down device 36 at the front of the automobile. The free end of the cable or chain 34 is typically affixed to any of a number of fixed points of attachment on the front end of the automobile. The drawing illustrates a point of attachment to the cowling 38 of the automobile.

As described above, the present method commonly used to apply a pulling force to the rear area of an automobile includes attaching a clamp (not shown) to the downwardly protruding lip 40 of the automobile body below the trunk floor 32. However, this procedure has caused many problems in recent years because the sheet metal in the area 40 is not strong, and it tears or otherwise is pulled out of shape when applying forces of sufficient magnitude to straighten the rear frame, body, or floor area of the automobile. Thus, the present invention provides the chisel clamp 30 and a method of attaching the chisel clamp to the trunk floor 32, for example, instead of to the lip 40, to provide a more secure pulling point which in turn, reduces the time and cost of repair work to the automobile.

Figure 2:
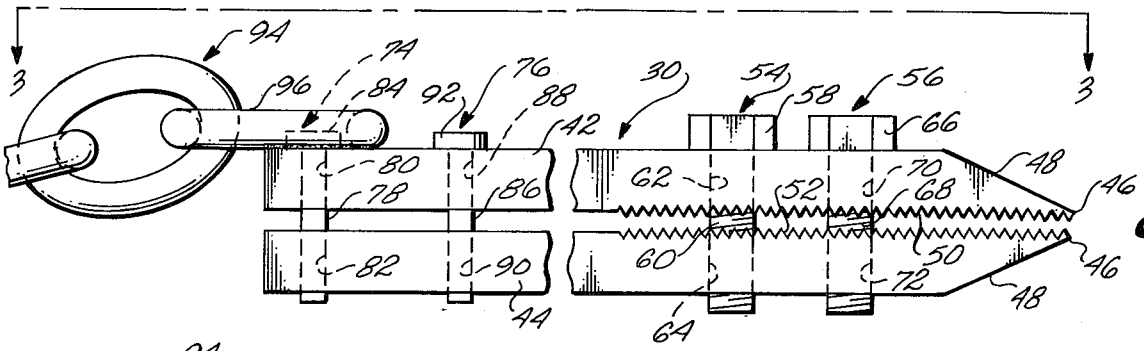
FIG. 2 is a fragmentary enlarged side elevation view showing the chisel clamp within the circle 2 of FIG. 1.
Figure 3:
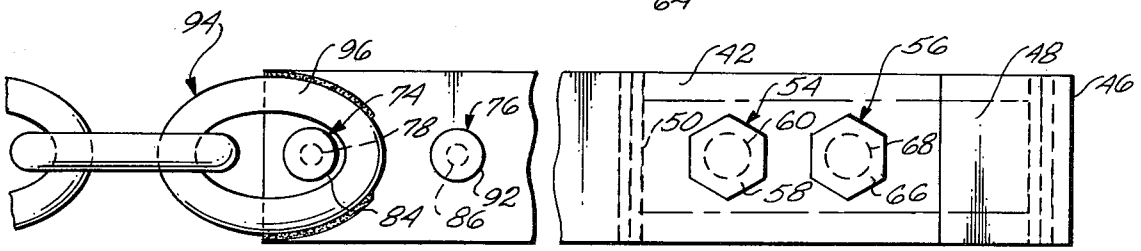
FIG. 3 is a fragmentary plan view taken on line 3—3 of FIG. 2.

The chisel clamp 30 will be understood best by referring to FIGS. 2 and 3. The clamp includes a pair of elongated upper and lower jaws 42 and 44, respectively. Each jaw is made from an elongated metal bar, preferably a piece of alloy steel about $\frac{3}{8}$ to $\frac{1}{2}$ inch thick. When viewed in plan view, each metal bar is relatively long, being about 1 foot in length, and having a width of about 2 to $2\frac{1}{2}$ inches. The jaws 42 and 44 preferably are heat-treated, such as by heating in an oven and quenching in oil to make the jaws relatively springy to avoid brittleness so that the jaws can withstand up to about 10 tons of force at the machine end without failing.

The jaws 42 and 44 are aligned in a parallel, side-by-side relation so that one jaw overlies the other. One end of each jaw has a blade edge 46 formed by a flat tapered end surface 48. Each blade edge 46 is flat and extends the width of the jaw lying in a plane extending normal to the longitudinal extent of the jaw. The upper jaw 42 has a serrated planar undersurface 50 extending immediately inboard from the blade edge 46 and extending for a substantial length of the jaw, say about one-half its length. Similarly, the lower jaw 44 has an identical serrated, planar upper surface 52 extending for a substantial extent inboard the blade edge 46. Thus, the serrated surfaces 50, 52 of the upper and lower jaws, respectively, face each other, as shown best in FIG. 2. Moreover, the blade edges 46 preferably lie in substantially the same plane as the serrated surfaces 50, 52.

A pair of longitudinally spaced apart fasteners 54 and 56 extend through the serrated portions 50, 52 of the upper and lower jaws. Fastener 54 preferably comprises a bolt having a conventional hex head 58 and a threaded shank 60 which is threaded through a pair of vertically aligned threaded holes 62, 64 in the upper and lower jaws 42, 44, respectively. Similarly, fastener 56 comprises a bolt having a hex head 66 and a threaded shank 68 releasably engaged with a pair of vertically spaced apart threaded openings 70, 72 in the upper and lower jaws 42, 44, respectively.

A pair of longitudinally spaced apart alignment pins 74 and 76 extend through the portions of the upper and lower jaws remote from the blade edges 46. The alignment pins can be any of a variety of means for aligning one jaw with the other so that the threaded holes 62 and 70 of the upper jaw are simultaneously aligned vertically with the threaded holes 64, 72 of the lower jaw 44. Preferably, the alignment pin 74 includes an elongated rounded shank 78 which fits snugly into a pair of vertically aligned rounded bores 80, 82 extending through the upper and lower jaws, respectively. The alignment pin 74 also includes a head 84 which is oversized with respect to either of the bores 80, 82 for use in holding the pin in place of the bores.

Similarly, the alignment pin 76 has an elongated rounded shank 86 which extends through a pair of vertically aligned rounded bores 88, 90 in the upper and lower jaws, respectively. Alignment pin 76 also includes an oversized head 92 for holding the pin in place in the bores 88, 90.

The alignment pins and their corresponding bores are arranged so that when the alignment pins are in place in their corresponding bores, the threaded openings 62, 70 of the upper jaw will be aligned vertically simultaneously with the threaded bores 64, 72 of the lower jaw; and the serrated surfaces 50, 52 of the jaws will face one another.

An elongated flexible chain 94 is rigidly affixed to either of the jaws, say by welding. In the configuration shown, the end link 96 of the chain 94 is welded to the top surface of the upper jaw 42. The chain preferably comprises a $\frac{3}{8}$ inch alloy steel chain of the type commonly used in straightening automobiles bodies.

In using the chisel clamp 30, the threaded fasteners 54, 56 and the alignment pins 74, 76 are removed to separate the upper jaw 42 from the lower jaw 44. Each jaw is then hammered through the sheet metal end wall portion 98 of the automobile body at the rear of the trunk floor 32. Each jaw is hammered through the body via the blade edge 46 so that the upper jaw 42 lies flat against the top surface of the trunk floor 32, and the bottom jaw 44 lies flat against the undersurface of the trunk floor 32. The jaws are hammered into place so that they are substantially in alignment with each other vertically to sandwich the trunk floor 32 between the serrated portions 50, 52 of the jaws. The flat end surfaces of the jaws opposite the blade ends facilitate hammering the jaws through the automobile body. When hammering one jaw above the trunk floor and the other below the trunk floor, the repairman is not able to correctly align the threaded holes 62, 70 with the holes 64, 72 because the serrated clamping surfaces of both jaws are not simultaneously visible. The end portions of the jaws remote from the blade edges remain outside the automobile body, and the alignment pins 78, 86 are used to correctly align the upper and lower jaws longitudinally, as well as laterally, so that the threaded bores for the fasteners 54, 56 will be aligned properly when the alignment pins 78, 86 are in place. This allows the repairman to punch out holes through the sheet metal trunk floor 32 in alignment with the threaded bores of the upper and lower jaws so that the fasteners 54, 56 may be inserted in their corresponding holes and tightened. The fasteners 54, 56 are tightened sufficiently to tightly grip the trunk floor between the serrated portions of the upper and lower jaws to provide a secure pulling point or anchor point when subsequently straightening the automobile body or frame.

The attachment to the trunk floor via the chisel clamp 30 provides a more secure point of attachment than the lip 40 of the automobile body because the trunk floor itself is generally of more rigid, double metal construction providing an attachment point of much higher strength than the automobile body itself. Once the chisel clamp is securely fastened in place, the chain 94 is either anchored to a tie-down point, or attached to the hydraulic pulley apparatus 12, as shown in FIG. 1, to provide means for straightening an automobile body member. The chisel clamp also can be affixed to other structural members of the automobile to provide a desired anchor or pulling point.

Thus, the invention provides a structurally sound anchor point or pulling point when straightening an automobile body member. The chisel clamp of this invention avoids marring, tearing, or otherwise pulling out of shape the body of the automobile itself when straightening an automobile, and thus can save the body repairman and the customer substantial amounts of time and money. Moreover, the chisel clamp is relatively simple and inexpensive to manufacture, and is universally adaptable for a variety of different sizes and styles of automobiles, as well as being easy and reliable to use.

I claim:

1. A chisel clamp for use in the application of force when straightening an automobile body member, the clamp comprising a pair of elongated jaws each having a blade edge at one end, and an elongated serrated clamping surface extending inboard from the blade edge; fastening means for releasably extending through the serrated portions of the jaws and for being loosened or tightened so the serrated clamping surfaces of the jaws can apply a controllable amount of pressure to the opposite sides of a workpiece sandwiched between the jaws; alignment means for extending through a portion of the jaws on a side of the fastening means opposite the blade edges for holding the jaws in an overlying relation so the clamping surfaces thereof face one another and for aligning the jaws with one another to facilitate extending the fastening means through the jaws; and flexible chain means rigidly affixed to at least one of the jaws adjacent an end thereof opposite the blade edge for use in cooperating with the jaws to apply force to an automobile body member via the attachment to the workpiece.

2. Apparatus according to claim 1 in which the fastening means comprises at least a pair of threaded fasteners extending through respective aligned threaded holes in the jaws.

3. Apparatus according to claim 2 in which one end of each jaw comprises a straight blade edge having a length extending normal to the longitudinal extent of the jaw.

4. Apparatus according to claim 3 in which the thickness of each jaw tapers narrower toward the blade edge, and the jaws are disposed so that the blade edges are adjacent one another and the tapered surfaces thereof are remote from one another.

5. Apparatus according to claim 2 in which the alignment means comprise longitudinally spaced apart pins extending through aligned openings in the jaws adjacent the ends thereof opposite the blade ends.

6. Apparatus according to claim 1 in which each jaw is a narrow elongated member having a length which is substantially longer than the width and thickness of the jaw.

7. Apparatus according to claim 6 in which the end of each jaw opposite the blade includes a flat surface to facilitate hammering the jaws into an automobile body.

8. Apparatus according to claim 7 in which the fastening means comprises at least a pair of threaded fasteners extending through respective aligned threaded holes in the jaws.

9. A method for straightening an automobile body member in an automobile having a rigid structural member adjacent a sheet metal side wall of the automobile body and having opposite surfaces extending away from the body side wall, the method including the steps of:

providing a chisel clamp having separate elongated first and second jaws, each jaw having a blade edge at one end thereof, a serrated clamping surface extending inboard from the blade edge, an opposite end portion remote from the blade edge, and means for receiving fastening means extending through the serrated portion of the jaw;

hammering the blade edge of the first jaw into the body side wall to position the jaw so the serrated clamping surface thereof overlies one surface of the structural member, with the remote end portion of the first jaw extending outside the body side wall away from the structural member;

hammering the blade edge of the second jaw into the body side wall to position the jaw so the serrated clamping surface thereof overlies the opposite surface of the structural member, with the remote end portion of the second jaw extending outside the body side wall away from the structural member;

aligning the remote end portions of the jaws with respect to one another so that the serrated surfaces of the jaws will be aligned with one another to sandwich the structural member between them and so that the fastener-receiving means of each jaw will be aligned with that of the other jaw while the structural member is disposed between the jaws;

extending fastening means through the serrated portion of one jaw, through an opening in the structural member, and then through the serrated portion of the other jaw, and tightening the fastening means to clamp the serrated surfaces of the jaws against the opposite surfaces of the structural member; and providing a flexible chain means rigidly affixed to the remote end of at least one of the jaws for use in applying a force to the automobile body member via the attachment to the structural member.

10. The method according to claim 9 including providing longitudinally spaced apart, aligned threaded holes in the first and second jaws; extending a threaded fastener through each set of aligned threaded holes; and tightening the fasteners.

11. The method according to claim 10 including providing alignment pin means in the remote end portions of the jaws, and engaging the alignment pin means to provide a corresponding alignment of the threaded holes of the jaws prior to inserting the fastening means.

12. The method according to claim 11 including clamping the jaws to the opposite sides of a sheet metal floor structure of an automobile.

13. The method according to claim 10 including clamping the jaws to the opposite sides of a sheet metal floor structure of an automobile.

14. The method according to claim 9 including applying a pulling force to the flexible chain means.

15. The method according to claim 9 including attaching the free end of the flexible chain means to the ground to provide an anchor point for a pulling force applied to the automobile body member.

* * * * *